US006082598A

United States Patent [19]

Lee

[11] Patent Number: 6,082,598

[45] Date of Patent: Jul. 4, 2000

[54] SAFETY DISPENSER FOR A WATER PURIFIER

[76] Inventor: SungKeun Lee, Keuk-Dong Apt. #103-702, Palyong-Dong, Chang Won, Rep. of Korea

[21] Appl. No.: 09/206,880

[22] Filed: Dec. 8, 1998

[30] Foreign Application Priority Data

Oct. 31, 1998 [KR] Rep. of Korea ..... 98-21314

[51] Int. Cl.[7] ..... B22D 37/00

[52] U.S. Cl. ..... 222/509; 222/153.14; 222/505

[58] Field of Search ..... 222/509, 505, 222/153.14; 251/96, 98, 99

[56] References Cited

U.S. PATENT DOCUMENTS 2,936,098 5/1960 Narbo ..... 222/509
3,373,907 3/1968 Batrow ..... 222/509
4,720,076 1/1988 Hyde ..... 222/509 X

*Primary Examiner*—Joseph A. Kaufman
*Assistant Examiner*—Thach Bui
*Attorney, Agent, or Firm*—Notaro & Michalos P.C.

[57] ABSTRACT

A safety device for preventing children from pressing a dispenser supplying hot water in a water purifier has a shaft coupled to the center of the dispenser, for discharging hot water by moving the shaft up and down. A plate is installed at the upper end of the dispenser while being positioned on both sides of the shaft. The plate is connected to the shaft; a guide bar is connected to the plate and formed in unitary one-piece constructed with a spring insert bole which has a first spring having given restoration force. A movement element having an insert groove and, an insert hole for being coupled to the plate and the guide bar, can be moved to the front and rear to act as a fulcrum for raising the shaft when the plate is pivoted downwardly but only when the movement element is in its forward position.

7 Claims, 5 Drawing Sheets

SAFETY DISPENSER FOR A WATER PURIFIER

BACKGROUND OF THE INVENTION

1. Field of the Invention

The present invention relates to equipment with hot and cold (running) water (hereinafter, referred to as "a water purifier") and, more specifically, to a safety dispenser used for the water purifier and having a safety device for controlling operation of the dispenser supplying the hot water.

2. Description of the Related Art

Recently, due to destruction of the nature ecosystem with environment pollution, few people which use raw water supplied through waterworks as drinking water and more people are buying mineral water to drink. Water purifiers for water for drinking are also being used in households restaurants, the water purifiers having each dispenser for enabling hot water and cold water to be dispensed. Accordingly, a user can obtain hot water or cold water only when he places a cup at the wanted dispenser and presses a faucet of the dispenser.

But, as stated previously, because the water purifier had no safety device for preventing children from pressing the faucet of the dispenser, the children often scalded their bands with hot water by pressing the faucet of the dispenser dispensing hot water. Also, there was a problem that safety accidents were generated by general consumers by carelessly pressing the faucet of the dispenser without recognizing the dispenser properly.

In the meanwhile, a water purifier has been disclosed in a U.S. Pat. No. 5,449,144, entitled "FAUCET VALVE WITH SAFETY HANDLE" where a safety device is additionally and separately installed at the dispenser for supplying the hot water in a conventional water purifier in order to prevent children from pressing the dispenser therefor.

It is obvious that the patent as described above is somewhat useful in comparison with the conventional water purifier which generated safety accidents by children with carefully pressing the dispenser for supplying hot water, preferably, in comparison with the dispenser for supplying hot water in the water purifier.

However, in the above patent, only when an end portion 69 is pulled back, a cam surface 76 is moved to the upper surface of the dispenser and the end portion 69 is moved downwardly, general consumers can dispense hot water. The inconvenience occurs from the customer due to the operation of three steps as explained above, in that the end portion 69 is again moved downwardly in the state that the end portion 69 is pulled back. As well, there is often an occasion that the end portion 69 is easily slided at the tip of a finger. Likewise, since the end portion 69, the cam surface 76, and an actuator assembly 16 are always positioned downwardly in the case of not using the dispenser for supplying the hot water, the commodity may be deteriorated by giving an impression of damage of the dispenser seemingly.

SUMMARY OF THE INVENTION

It is an object of the present invention to provide a safety dispenser for a water purifier constructed with separately a safety device for preventing children from pressing the dispenser supplying the hot water.

It is another object of the present invention to provide a safety dispenser for a water purifier where operation steps of said safety dispenser for supplying hot water are simplified.

It is a further object of the present invention to provide a safety dispenser for a water purifier, having simplified construction of the safety device installed at the defenses for supplying hot water.

In order to achieve these and other objects, the present invention is provided with a safety dispenser for a water purifier, comprising: a shaft coupled to the center of the dispenser, for discharging externally hot water by moving at the front and rear; a plate installed at the upper end of the dispenser while being positioned on both sides of the shaft at given intervals, for operating upwardly and downwardly the shaft with being fixed at the shaft; a guide bar where one side end is connected to the plate and the other side end has given tension with separately forming projections projected on both sides, formed in unitary one-piece constructed with a spring insert hole which a first spring having given restoration force is inserted between the projections; and a movement element having an insert groove and an insert hole for being coupled to the plate and the guide bar, for releasing connection state of the shaft while moving at the front and rear, the plate formed with the guide bar in the unitary one-piece construction.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE PREFERRED EMBODIMENT(S)

Figure 1:
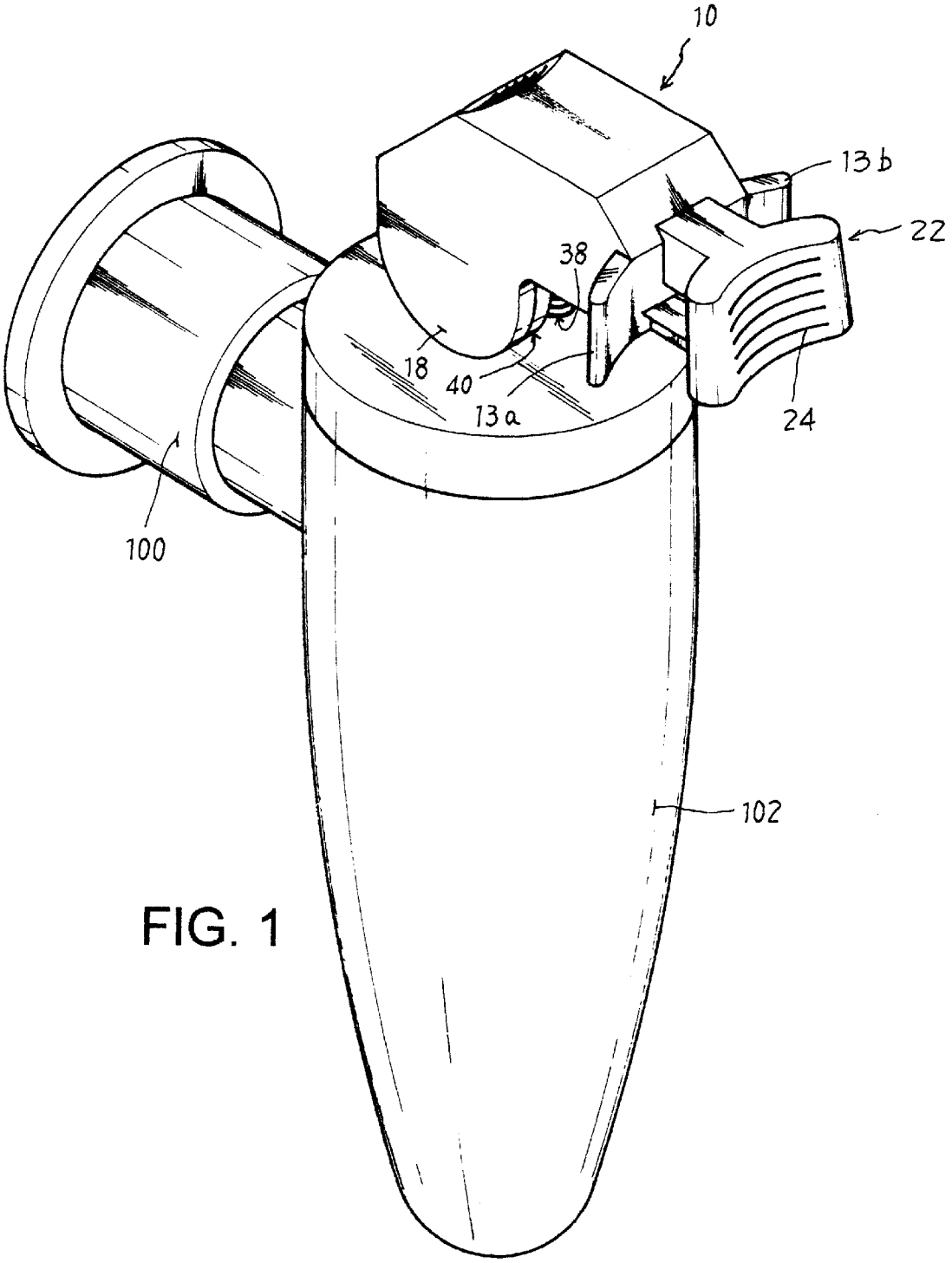
FIG. 1 is a perspective view showing the configuration of a safety dispenser for a water purifier according to a preferred embodiment of the present invention.

Hereinafter, a preferred embodiment according to the present invention will be concretely explained with reference to accompanying drawings. First, throughout the drawings, it is noted that the same reference numerals will be used to designate like or equivalent elements having the same function. Further, in the following description, it is noted that the detailed description on known function and constructions unnecessarily obscuring the subject matter of the present invention will be avoided in the description of the present invention.

FIG. 1 is a perspective view showing the configuration of a safety dispenser for a water purifier according to a preferred embodiment of the present invention. In FIG. 1, the safety dispenser 102 according to the present invention is coupled to a body of the water purifier by an assembling tube 100, has an actuating shaft 60 (see FIG. 6A) piercing the center of an upper surface of the safety dispenser 102, and discharges hot water externally by upward/downward operation of shaft 60. A handle 22 is deposited, at the upper end of the safety dispenser 102, preferably, at the upper end of the shaft 60. Also, the handle 22 is assembled with a movement element 10. Herein, the handle 22 fixes the s haft 60 to thereby prevent children from pressing the safety dispenser 102, and the movement element 10 releases connection of the shaft 60 fixed by the handle 22, thereby enabling hot water to be discharged.

Figure 2:
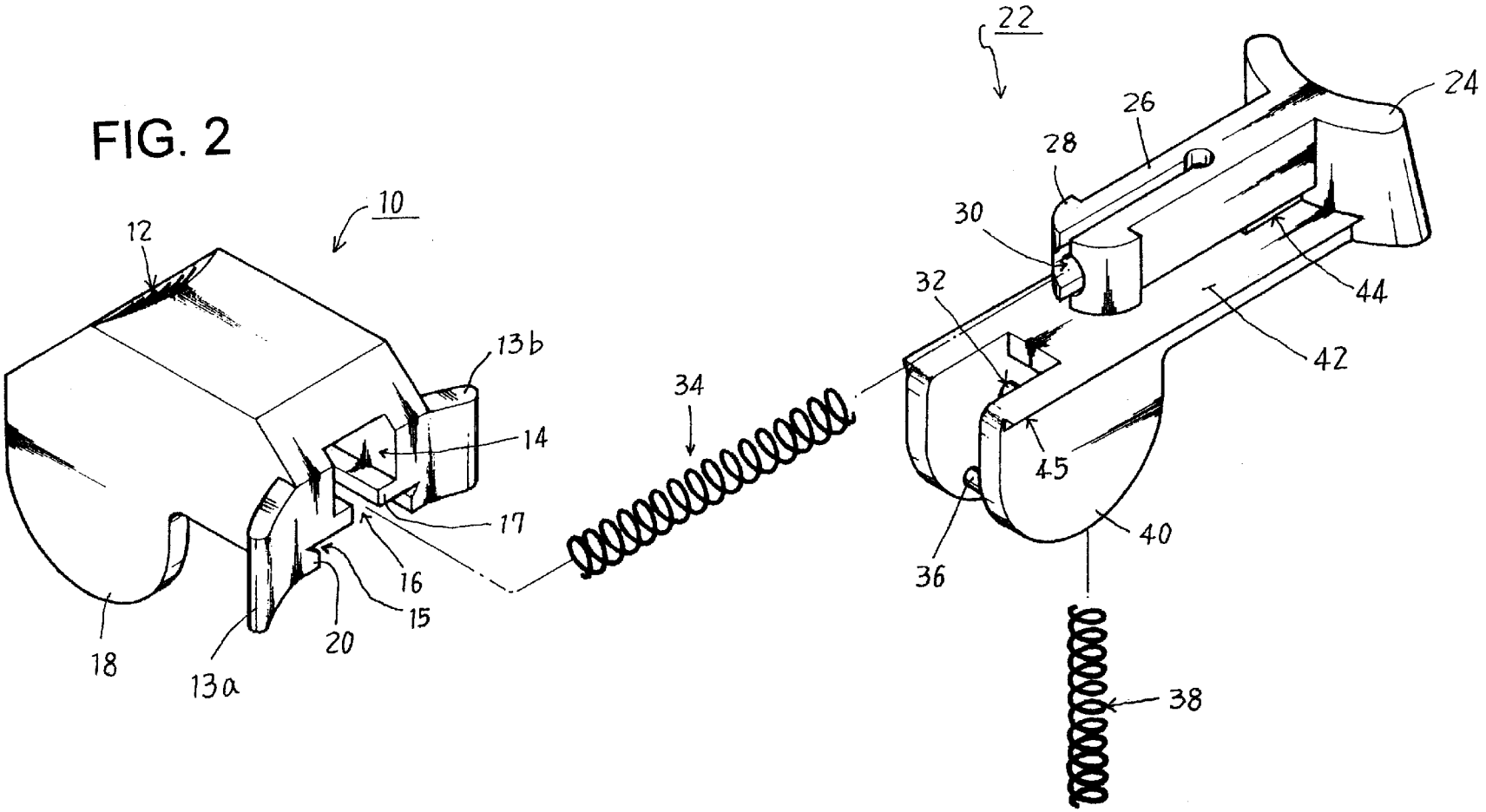
FIG. 2 is a separated perspective view showing the construction of a safety device for preventing children from pressing a dispenser supplying hot water in a water purifier according to the present invention.

FIG. 2 is a separated or exploded perspective view showing the construction of a safety device for preventing children from pressing the dispenser supplying hot water in a water purifier according to the present invention, that is, the movement element 10 and the handle 22. As below, the construction of the safety device constructed with the movement element 10 and the handle 22 will be in detail described with reference to FIGS. 2 to 4.

Figure 4:
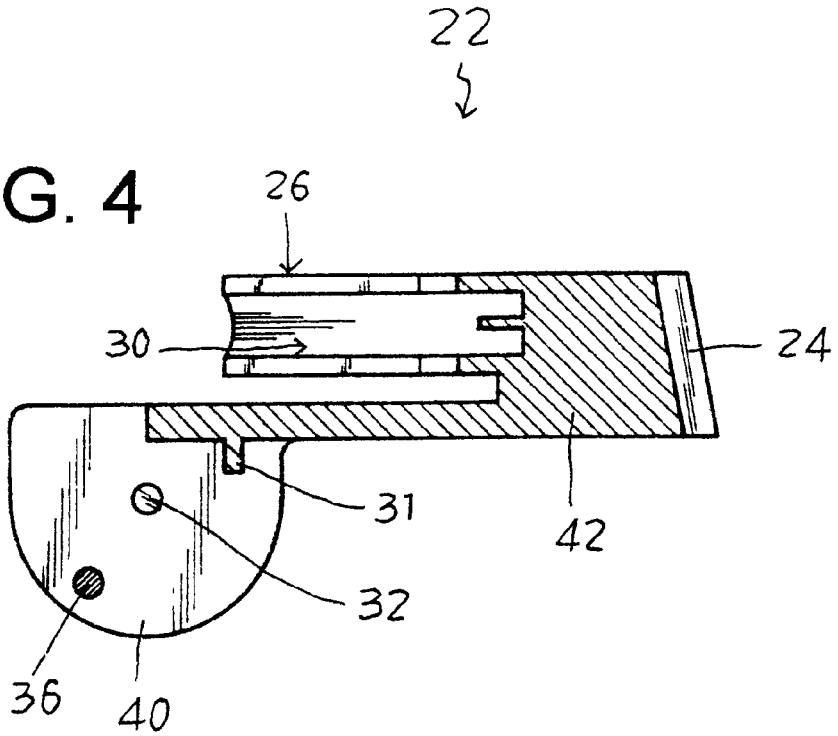
FIG. 4 is a sectional view showing inner configuration of a handle in FIG. 2.

The handle 22 is greatly divided into two parts as viewed in FIG. 2, one part corresponding to a plate 42 joined to the shaft 60 of the dispenser and the other part corresponding to a guide bar 26 assembled with the movement element 10 and receiving a first spring 34. At this time, the plate 42 and the guide bar 26 are preferably of unitary one-piece construction and may be formed of molded plastic. Also, at the right of the FIG. 2, a knob 24 having knurling surface is constructed with the plate 42 and the guide bar 26 in an unitary format. A u-shaped opening is located at the rear of the plate 42 and two first semicircular wings 40 that are rounded downwardly are formed on both sides of the opening with the unitary format. Namely, the upper end of the plate 42 is flat, the opening is downwardly formed at the rear of the plate 42, as shown at the left of FIG. 2, and the two semicircular wings 40 are downwardly extended and formed on both sides of the opening. At this moment, the second semicircular wings 40 are located at the upper end of the safety dispenser 102 and the shaft 60 is positioned between the semicircular wings 40 and the safety dispenser 102. A projection 32 extending from the center of the inside of each of the two semicircular wings 40, is coupled to the shaft 60. Below the projections 32, a locking sinker 36 or stop is adhered between of the inside of the semicircular wings 40, for preventing the movement element 10 assembled with the handle 22 from moving in the direction of the body of the water purifier. Here, a protrusion 31 (FIG. 4). Is made at the bottom surface of the plate 42 and a second spring 38 is coupled to the protrusion 31. In this case, the second spring 38 prevents the movement element 10 assembled with the handle 22 from moving down in the direction of the body of the water purifier. Guide ribs 45 having a triangle shape are extended and formed at the front and the rear of both side ends of the plate 42, which are jointed to a triangle groove 15, as will be described hereinafter, of the movement element 10. In this event, the guide ribs 45 and the triangle groove 15 block movement/vibration of the handle 22 when the handle 22 is assembled with the movement element 10.

The guide bar 26 is, at a given spacing, positioned at the upper end of the plate 49, and the plate 42 and the guide bar 26 are formed of molded plastic in one-piece construction unitary with the knob 24. Also, a guide projection 44 is shaped between the guide bar 26 and the plate 42 and the length of the guide projection 44 corresponds to ⅓ of the total length of the guide bar 26. Namely, the plate 42, the guide bar 26, and the guide projection 44 are all formed of molded plastic with the one-piece construction unitary with the knob 24. The guide bar 26 is divided into two parts by a slot 30 as shown in FIGS. 2 and 4, so it can flex without destruction when of inserting the guide bar 26 into an insert hole 14 of the movement element 10 and for moving the guide bar 26 to the front and the rear. Further, a locking projection 28 projected on both sides is formed with the unitary format at the end portion of the guide bar 26, a and the first spring is inserted in a hole in slot 30. The first spring 34 always restores the handle 22 with given tension to an initial place on element 10.

Figure 3:
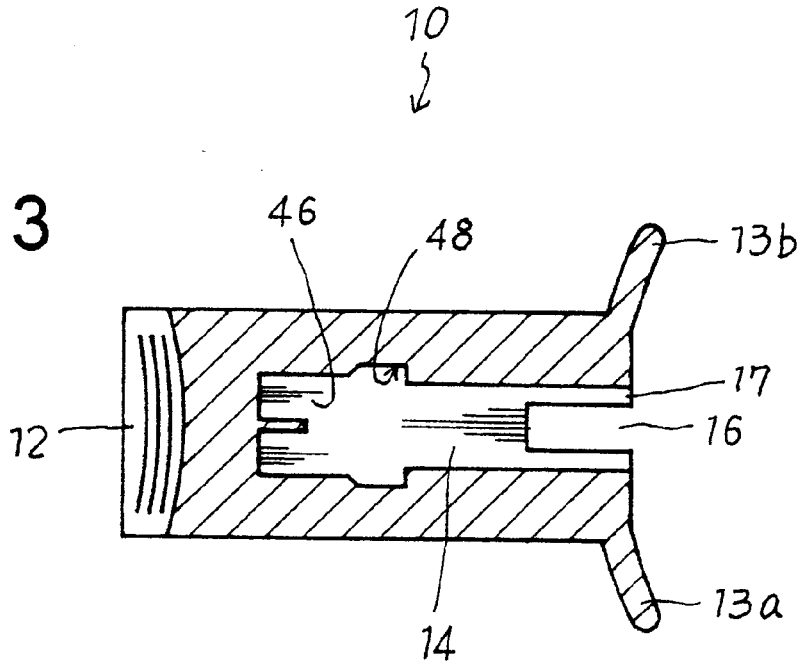
FIG. 3 is a sectional view showing inner configuration of a movement element in FIG. 2.

The movement element 10 assembled with the handle 22 has two seond semicircular wings 18 that are downwardly extended and formed at the rear on both sides of the movement element 10 at given spacing. That is, the upper end of the movement element 10 is formed to be flat and an insert hole 14, an incise groove 16, and an insert groove 20 are shaped in alignment with one another at the lower end of the movement element 10. Namely, ribs 17 extended at the front and rear are mounted in the unitary format between the insert hole 14 and the insert groove 20, thereby having the incise groove 16. Each of triangle grooves 15 having the triangle format is disposed on both side ends of the rear surface of the ribs 17, preferably, between the upper end of the insert groove 20 and the rear surface of the ribs 17, said triangle groove 15 formed for inserting the guide ribs 45. At this point, the plate 42 is coupled to the insert groove 20, the guide bar 26 is inserted into the insert hole 14, the guide projection 44 is inserted into the incise groove 16, and the guide ribs 45 are engaged to the triangle grooves 15, sequentially. Hereinbefore, the diameter of the insert hole 14 of the movement element 10 into which the guide bar 26 is inserted is increased more and more at the rear. That is, as illustrated in FIG. 3, the insert hole 14 is positioned at the opening of the movement element 10, a locking groove 48 to which the projection 28 of the guide bar 26 is engaged, is made at the rear of the insert hole 14 (at the left of FIG. 3), and an extending hole 46 having the diameter more than that of the insert hole 14 is shaped at the rear of the locking groove 48. Here, the right end of the locking groove 48 makes a right angle and the left end thereof is slanted at the given angle, so that the projection 28 can move not frontwardly but rearwardly. Finally, a slanted surface 12 having knurling surface is made on both side ends of the front of the movement element 10, and knobs 13*a* and 13*b* rounded at the given angle are each formed at both side ends of the front of the movement element 10. At this moment, the knobs 13*a* and 13*b* provide the convenience when pushing the movement element 10. frontwardly. Preferably, the movement element 10 is pushed in the case of grasping and pushing the knobs 13*a* and 13*b* right now without pulling the slanted surface 12.

Hereinbelow, the use of the safety dispenser integral with the safety device of the present invention constructed as described above will be explained with reference to FIGS. 5A to 6C.

Mostly, as illustrated in FIG. 1, the safety device, preferably the movement element 10 integral with the handle 22 is always placed to be tight at the upper end of the safety dispenser 102. In this state, hot water is not discharged at the safety dispenser 102 even when the children touch the safety dispenser 102 or the safety device. That is, since the center of the movement element 10, preferably, the longitudinal center of the first semicircular wing 18 and the center of the shaft 60 are equal to each other, the shaft 60 left in its lower inactive position and is not operated even when pressing the knob 24.

Figure 5A:
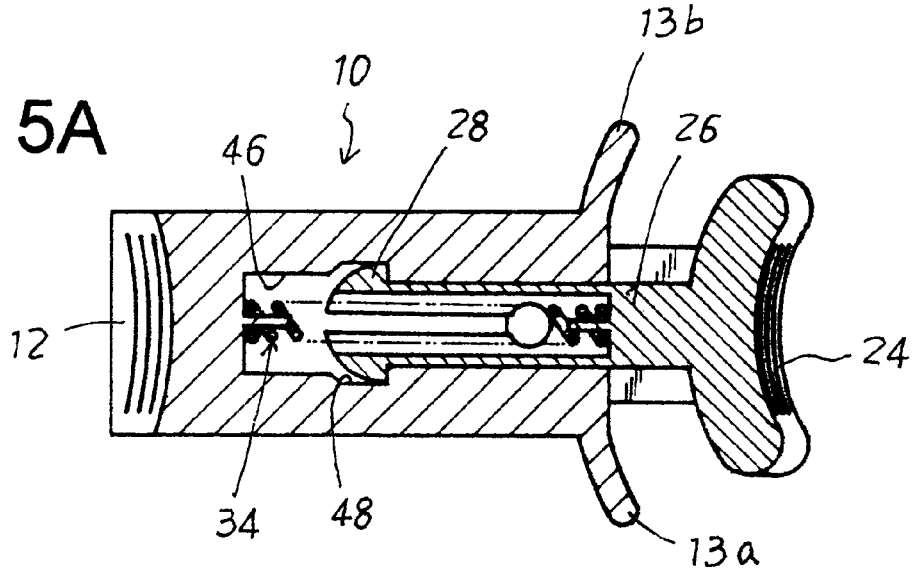
FIGS. 5A and 5B are sectional views showing the operation state of the movement element and the handle in the safety dispenser for the water purifier according to the present invention.
Figure 5B:
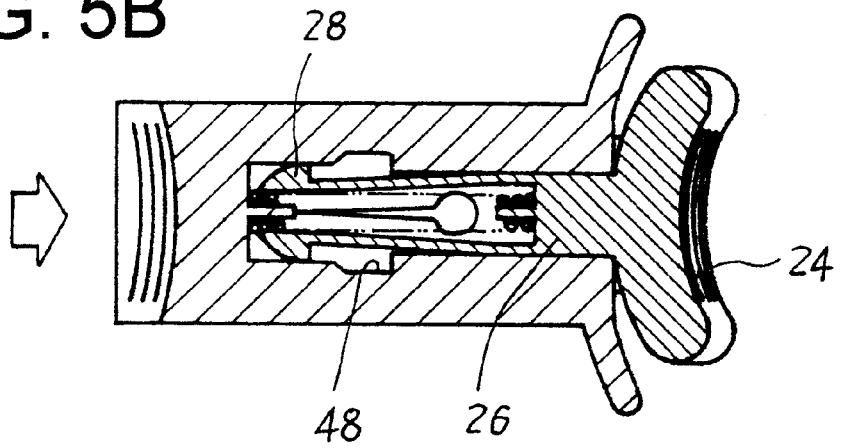
Figure 6A:
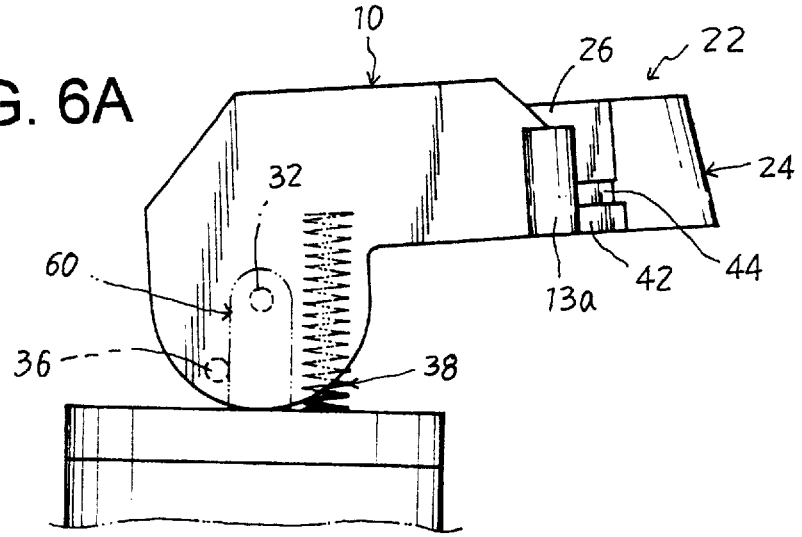
FIGS. 6A, 6B and 6C are sectional views showing the use state of the safety dispenser for the water purifier according to the present invention.
Figure 6B:
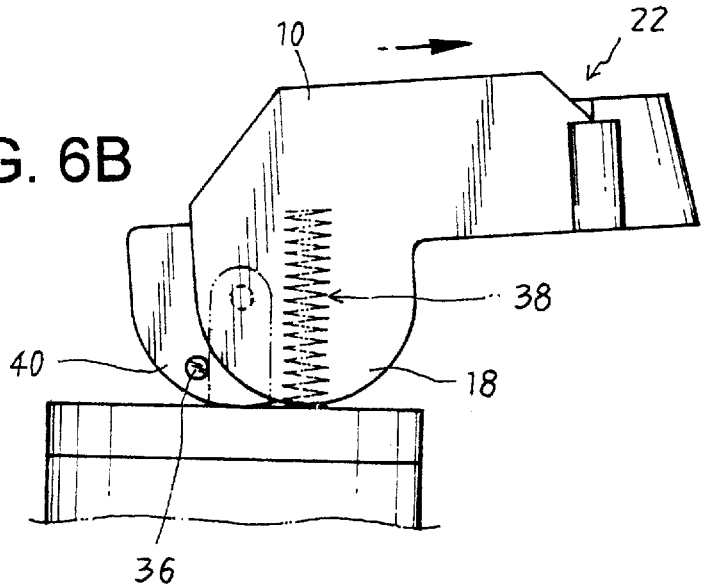

Hereinafter, only when the people grasp the slanted surface 12 of the movement element 10 and the knob 24 of the handle 22 and push the movement element 10 frontwardly, they can drink hot water, as shown in FIGS. 5A and 6A. The movement element 10 is more easily pushed forwardly when grasping the knob 24 of the handle 22 and the knobs 13*a* and 13*b* of the movement element 10. Further, as shown in FIG. 5B, simultaneously, the first spring 34 is compressed in the above case and the projection 28 of the guide bar 26 is inserted into the extending hole 46 out of the locking groove 48. At the same time, as shown in FIG. 6B, the longitudinal center of the first semicircular wings 18 of the movement element 10 is moved as much as the longitudinal center of the second semicircular wings 40 of the handle 22, preferably, as the given distance with the shaft 60, thereby enabling the shaft 60 to be operated upwardly and downwardly. That is, the center of the movement element 10 and the center of the shaft 60 are not conformed with each other, thereby placing the shaft 60 to be free. Here, since the extending hole 46 has more width than that of the insert hole 14, the projection 28 is inserted into the extending hole 46 without trouble, so that the projection 28 can be pierced from the extending hole 46 without problem even when the movement element 10 is placed at the initial position by restoration force of the first spring 34, hereinafter.

Figure 6C:
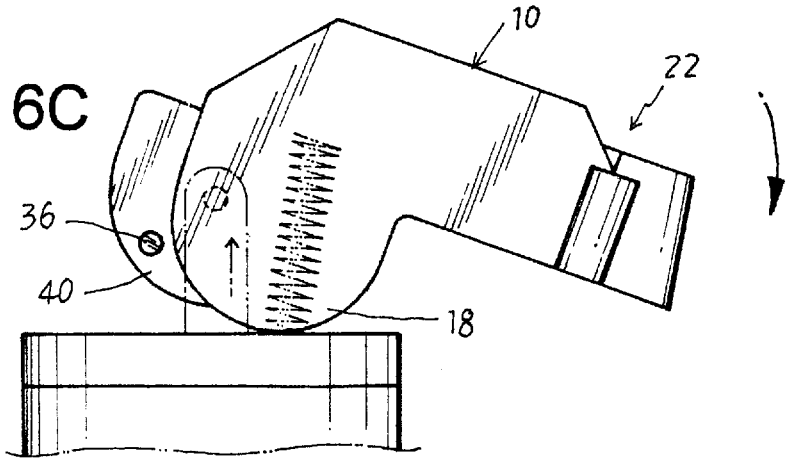

Further, as shown in FIG. 6C, when grasping and downwardly pressing the knob of the handle in the state of pushing the movement element 10, the actuating shaft 60 is raised by the principle of the lever into its active position, so that hot water can be discharged through the safety dispenser 102. In this case, the second spring 38 is compressed by the pressurization force of the plate 42. Herein, the first semicircular wing 18 of the movement element 10 plays the part of the lever. As below, in the case of eliminating the force of the finger grasping the knob 24, the movement element 10 is restored to the initial position by the restoration force of the second spring 38 as well as the handle 22 is moved frontwardly by the first spring 34 to thereby restore to the original place, simultaneously.

As may be seen from the foregoing, the present invention is mounted with the safety device at the upper end of the dispenser supplying hot water in order that the children can not press the dispenser, thereby preventing accidents from being generated because children do not operate the safety dispenser at themselves. The safety dispenser according to the present invention simplifies its operation steps, thereby providing the convenience in that consumers can easily drink hot water. Also, assembling steps can be decreased and the productivity can be enhanced by simplifying the construction of the safety device for controlling the operation of the dispenser supplying hot water. In particular, the safety device according to the present invention is tightly installed at the upper end of the dispenser, thereby enhancing the reliability of the product and value of the product.

Therefore, it should be understood that the present invention is not limited to the particular embodiment disclosed herein as the best mode contemplated for carrying out the present invention, but rather that the present invention is not limited to the specific embodiments described in this specification, except as defined in the appended claims.

What is claimed is:

1. A safety device for a dispenser of hot water in a water purifier, the dispenser having an upper surface with an actuating shaft moveable between an upper active position for dispensing hot water and a lower inactive position for not dispensing hot water, the safety device comprising:

a plate extending over the upper surface, said plate having a pair of first spaced apart wings positioned on opposite sides of the shaft and pivotally connected to the shaft at a pivot connection, at least parts of said first wings being engaged with said upper surface for raising and lowering the shaft with movement of the plate;

a guide bar having a first end connected to said plate and an opposite second end, the opposite second end of said guide bar including a pair of projections which are resiliently movable toward and away from each other with a spring insert hole between said projections;

a movement element having an insertion groove for slidably receiving said plate and an insertion hole for slidably receiving said second end and said projections of said guide bar, said movement element having a pair of second wings engaged with said upper surface of said dispenser and being slidably mounted with respect to said guide bar into a first position where movement of said plate causes no upward and downward movement of said shaft, said movement member being moveably into a second position where movement of said plate causes upward movement of said shaft into the active position of said shaft due to engagement of said movement element with said upper surface; and a spring engaged in said spring insert hole and between said guide bar and said movement element for biasing said movement element toward its first position.

2. A safety device according to claim 1 wherein said first and second wings include semicircular portions engaged with the upper surface of said dispenser, the semicircular portions having centers, the centers being offset when the movement element is in its second position and the centers of the first semicircular wings corresponding to the connection point between the first wings and the shaft.

3. A safety device according to claim 1 including a stop between said first wings, said stop being engaged with said shaft for fixing a pivotal position of said plate with respect to said shaft when the shaft is in its lower inactive position.

4. A safety device according to claim 1 including a further spring engaged between the upper surface of the dispenser and said plate for biasing said plate upwardly into a position corresponding to the inactive position of the shaft.

5. A safety device according to claim 1 wherein said insertion hole in the movement element includes steps for engagement with the projections for preventing removal of the guide bar from the insert hole of the movement element.

6. A safety device according to claim 1 including a knob connected to said plate and guide bar, said knob, plate and guide bar being a unitary one-piece construction.

7. A safety device according to claim 6 wherein said movement element includes a slanted surface on the movement element at a location opposite from the knob for use in conjunction with the knob for aiding the sliding of the movement element with respect to the guide bar.

* * * * *